United States Patent [19]

Pugh et al.

[11] Patent Number: 4,954,084

[45] Date of Patent: Sep. 4, 1990

[54] SHAFT-GROUNDING STUFFING BOX COVER

[75] Inventors: John F. Pugh, Bellevue; Ann L. Magallanes, Redmond, both of Wash.

[73] Assignee: Marine Hardware, Inc., Redmond, Wash.

[21] Appl. No.: 404,286

[22] Filed: Sep. 6, 1989

[51] Int. Cl.[5] ..... H01R 39/00; H01R 4/66

[52] U.S. Cl. ..... 439/29; 439/95; 439/100; 439/101; 439/926

[58] Field of Search ..... 439/28, 29, 100, 101, 439/108, 95, 97, 521, 524, 824, 926, 930

[56] References Cited

U.S. PATENT DOCUMENTS

| | | | |
|---|---|---|---|
| 3,038,972 | 6/1962 | Lagier | 439/101 |
| 3,201,739 | 8/1965 | Caldwell | 439/28 |
| 4,344,630 | 8/1982 | Veres | 277/4 |

*Primary Examiner*—Paula A. Bradley

*Attorney, Agent, or Firm*—Christensen, O'Connor, Johnson & Kindness

[57] ABSTRACT

A shaft-grounding stuffing box cover (10) includes an annular nut-base (12) that includes a central aperture (14) through which a rotating shaft (16) passes. Two grounding tabs (28 and 30) project longitudinally upwards from the proximal end of the nut-base (12) adjacent the rotating shaft. The grounding tabs include diametrically opposed radial openings (18) that are longitudinally displaced from each other for the mounting of conductive brush contacts (20) therein. The conductive brush contacts are biased against the rotating shaft by backing springs (46), and are retained within the radial openings by hollow bolts (48). The hollow bolts, spring, and brush contacts form an electrically conductive path to the rotating shaft for grounding of the shaft.

14 Claims, 4 Drawing Sheets

SHAFT-GROUNDING STUFFING BOX COVER

TECHNICAL FIELD

This invention relates to grounding systems for rotating shafts and, more particularly, to a grounding system for marine propeller shafts.

BACKGROUND OF THE INVENTION

Boat propeller shafts are typically subject to corrosion due to their constant immersion in water. The problem is most acute for propeller shafts in marine vessels due to the tendency of sea water to act as an electrolyte, causing galvanic corrosion.

A conventional inboard boat engine is mounted within the hull of a boat and linked to a propeller shaft that projects through a passageway in the hull and into the water below. The shaft passageway is typically fitted with a through-hull fitting mounted inside the hull adjacent the passageway and angled to accomodate passage of the rotating shaft therethrough. After entering the hull, the rotatable shaft passes through an inboard stuffing box, attached to the through-hull fitting by a flexible hose, to form a watertight seal around the shaft. The stuffing box typically includes a generally cylindrical housing, open on both ends, through which the rotating shaft passes. An annular fiber stuffing, or packing, material, which acts as a bearing for the rotating shaft and forms a watertight seal around the shaft, is placed onto the shaft and inserted into the stuffing box housing. An annular cover is then threaded, bolted, or otherwise secured to the stuffing box housing to compress the stuffing therein around the shaft.

The components of conventional stuffing boxes are dimensioned such that the rotating shaft comes into contact only with the substantially electrically insulative stuffing material. The end of the propeller shaft that projects into the water is further supported by an electrically insulative rubber bearing mounted within a strut fitting projecting from the underside of the hull. The inboard end of the propeller shaft is drivingly interconnected to the engine by an oil lubricated gear box that also provides a fair degree of electrical insulation. In larger vessels, the inboard portion of a propeller shaft may also pass through one or more bulkheads, disposed crosswise within the hull between the stuffing box and the engine. Each bulkhead is typically adapted with a bulkhead stuffing box configured similarly to that mounted on the hull to seal the passage of the shaft through the bulkhead. Conventional bulkhead stuffing boxes also tend to electrically insulate the propeller shaft.

As a result of the electrical insulation of the propeller shaft in conventionally configured vessels, the propeller shafts are subject to galvanic corrosion when immersed in fresh water and especially when immersed in salt water. Corrosion of the propeller shaft can result in weakening of the shaft or leakage of water past the shaft into the hull of a boat.

A conventional attempt to solve the problem of general corrosion in marine vessels involves cathodic protection of the metallic components of the vessel. Sacrificial anodes are mounted on the immersed portion of the hull or suspended by lines dropped in the water adjacent the hull exterior. The sacrificial anodes are formed from a metal that is less noble (more chemically reactive) than the metals desired to be protected on the vessel. Typical sacrificial anodes are formed of zinc, with magnesium or aluminum also sometimes being utilized. The anodes and the metal portions of the boat form a galvanic couple, electrically linked by seawater. The more noble metal on the boat acts as a cathode that is protected by corrosion of the less noble sacrificial anodes. Cathodic protection serves to generally protect most metallic components, including the propeller shaft. However, because the propeller shaft is electrically isolated, anodes must be mounted underwater directly on the shaft. A diver must be employed to install the anodes, or ultimately the vessel must be pulled from the water, both resulting in substantial expense.

A method for directly protecting the propeller shaft from corrosion is disclosed by U.S. Pat. No. 3,201,739, which teaches the electrical grounding of a rotating propeller shaft. The electrical grounding assembly discloses a generally semicircular conductive band that is positioned adjacent and surrounding one side of the propeller shaft. Two arcuate-shaped electrical brush contacts are mounted to the interior of the semicircular band and contact the shaft. Each end of the semicircular band is secured to a length of chain, with the chains joining at a point radially distant from the shaft and diametrically opposed from the band. The free end of the joined chains are connected to an anchor point. A spring mounted on the joined portion of the chain biases the brush contacts against the rotating shaft. An electrical lead is connected to the semicircular band to place the shaft in electrical contact with the grounding system of the boat. This mechanism is very cumbersome, involving several large parts that must be properly connected and which take up valuable room within the boat. In addition, the electrical brush contacts, while radially spaced around the circumference of the shaft, are longitudinally aligned along the axis of the shaft. The two contacts tend to wear a groove within the rotating shaft over the course of time, potentially shortening, the useful life of the shaft.

SUMMARY OF THE INVENTION

The present invention provides a system for electrically grounding a rotating shaft to prevent corrosion of the shaft. The grounding system is integral with a stuffing box cover. In a preferred embodiment of the invention, an annular stuffing box cover includes a central aperture through which a propeller shaft passes and two grounding tabs projecting toward the engine along the longitudinal axis of the shaft. Each grounding tab includes an opening formed radially therein for the mounting of an electrically conductive brush contact. The two openings are disaligned along the longitudinal axis of the rotating shaft to prevent excessive wear of the shaft. A coil spring is inserted behind each brush contact, and a hollow bolt is threaded into the opening behind the spring contact. The hollow bolt compresses the spring against the brush contact to bias the contact against the rotating shaft. The cover is installed in electrical contact with a stuffing box housing, to which an electrical lead may be connected to place the stuffing box cover and brush contacts in electrical contact with the ship's grounding system.

BRIEF DESCRIPTION OF THE DRAWINGS

The present invention will now be described in greater detail, by way of example, with reference to the accompanying drawings in which.

DETAILED DESCRIPTION OF THE PREFERRED EMBODIMENT

Figure 6:
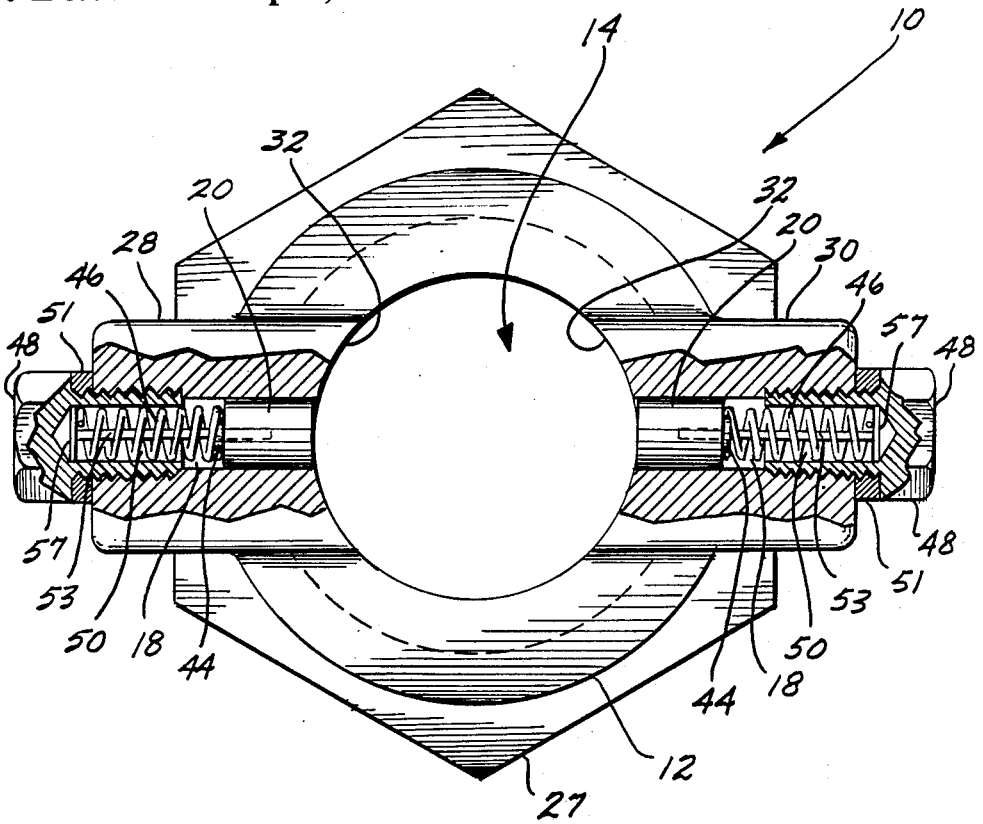
FIG. 6 is a top elevation view of the nut-type stuffing box cover with partial cross-sectional views of the grounding mechanism.
Figure 7:
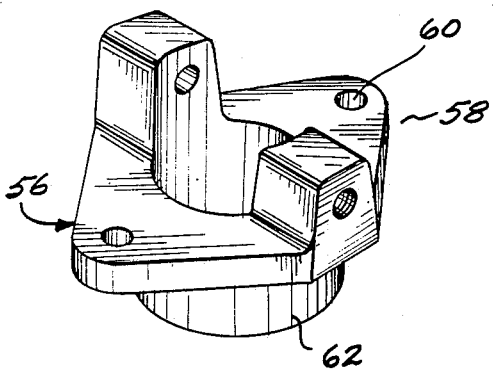
FIG. 7 is a perspective view of an alternate bulkhead-type stuffing box cover; and, FIG. 8 is a perspective view of an alternate gland-type stuffing box cover.
Figure 8:
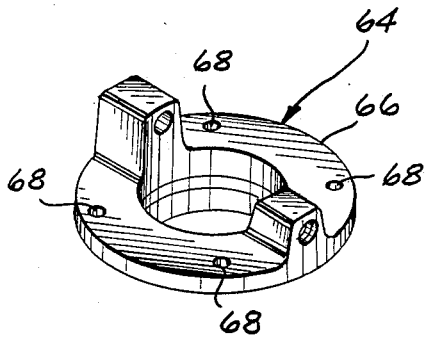

Conventional stuffing box covers generally are embodied as either a nut style as shown in FIGS. 1 through 6, a bulkhead style as shown in FIG. 7, or a flange style as shown in FIG. 8. The shaft-grounding stuffing box covers illustrated have been adapted in accordance with the present invention to provide for electrical grounding of a shaft passing therethrough, but are otherwise of conventional design.

Figure 1:
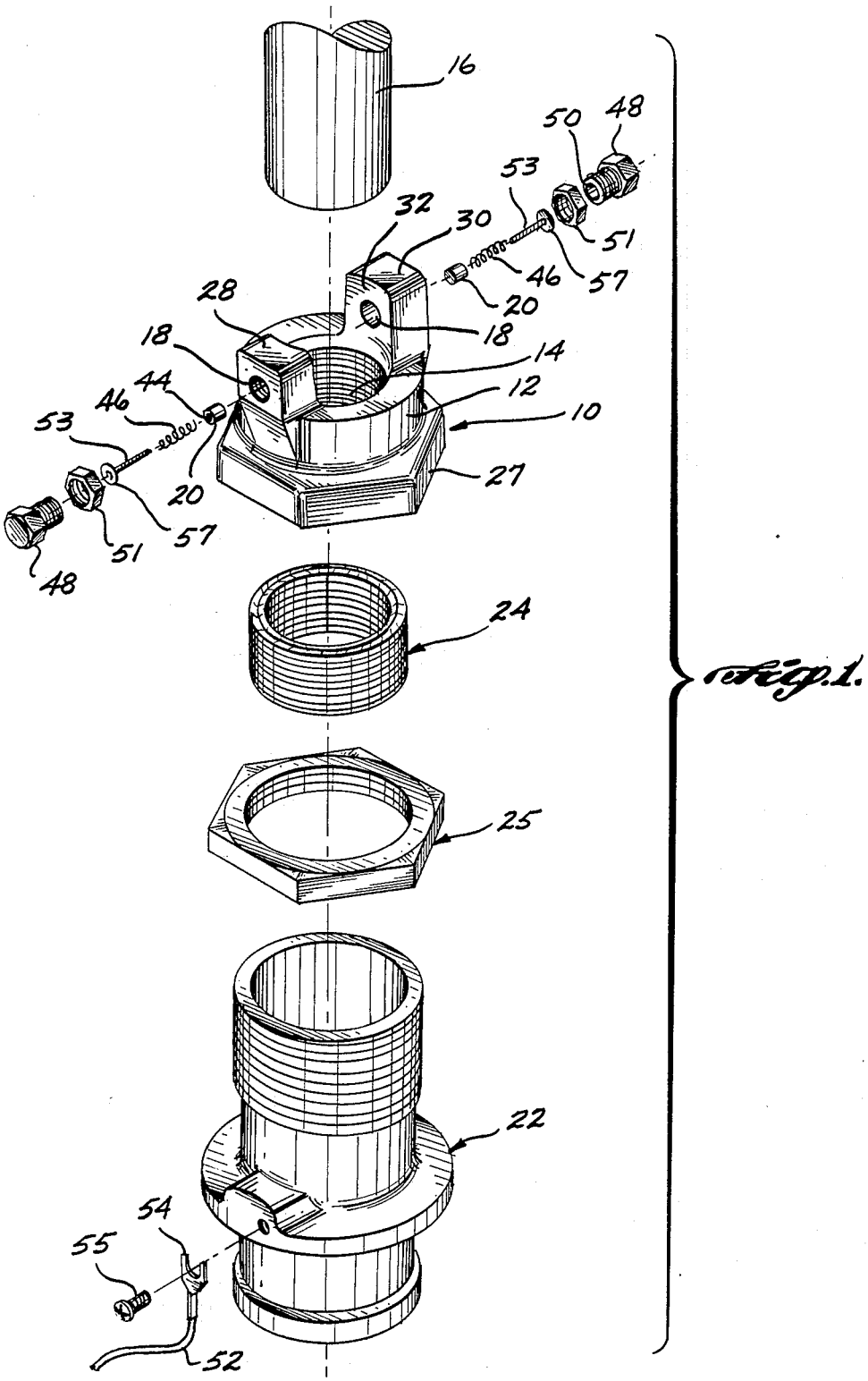
FIG. 1 is a perspective view of a preferred embodiment of the present invention embodied in a nut-type stuffing box cover shown mounted on a propeller shaft.

One preferred embodiment of a nut style stuffing box cover 10 is shown in FIG. 1. The stuffing box cover 10 includes an annular nut-base 12 that includes a central aperture 14 for receiving a propeller shaft 16, and two radial openings 18 that receive conductive brush contacts 20 to create an electrical path to the shaft 16. The stuffing box cover 10 is mounted to a stuffing box housing 22 containing a packing material 24 that seals against the rotating shaft 16. A jam nut 25 may additionally be threaded onto the housing 22 to ensure that the cover 10 does not become loose.

Referring to the perspective illustration of FIG. 1 and the detailed views of FIGS. 2 through 5, the central aperture 14 formed in the nut-base 12 is slightly larger than the outer diameter of the shaft 16. The nut-base 12 also includes a threaded bore 26, of larger diameter than the central aperture 14, formed coaxially with the aperture 14 within the nut base's distal end (the end closest in proximity to the stuffing box). A hexagonal flange 27 is formed around the distal end of the nut-base 12 to allow for engagement by a wrench to install the cover 10 onto a threaded shank portion of the stuffing box housing 22. The packing material 24 is compressed by the cover 10 to provide a watertight seal against the shaft 16 while allowing the shaft to freely rotate.

The shaft-grounding cover 10 also includes a brush holder mechanism to secure the conductive brush contacts 20. In the preferred embodiment illustrated in FIGS. 1 through 7, the brush holder is formed by first and second grounding tabs 28 and 30 that project from the proximal end of the nut-base 12 toward the engine, parallel to the longitudinal axis of the shaft. The first and second grounding tabs 28 and 30 are formed integrally with the nut-base 12 from a conventional marine hardware material such as red brass. The grounding tabs 28 and 30 are preferably oriented substantially diametrically opposite around the rotating shaft so that pressure is evenly applied to the shaft by the brush contacts.

Figure 4:
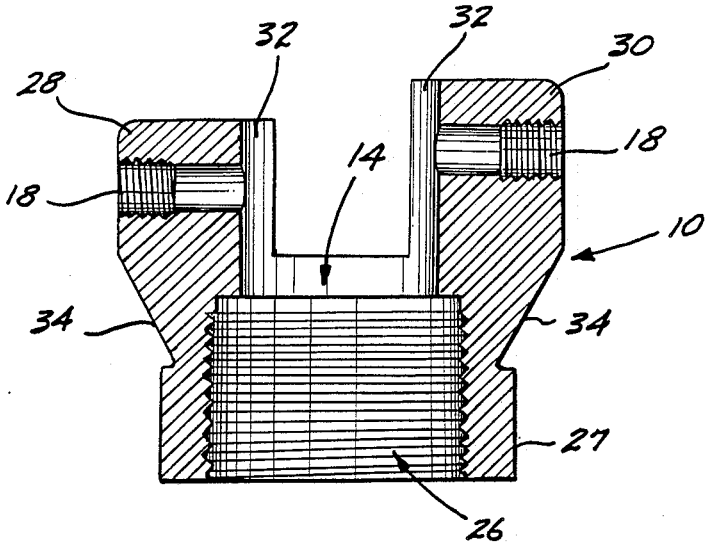
FIG. 4 is a cross-sectional view of a nut-type stuffing box cover taken substantially along line 4—4 of FIG. 3.
Figure 5:
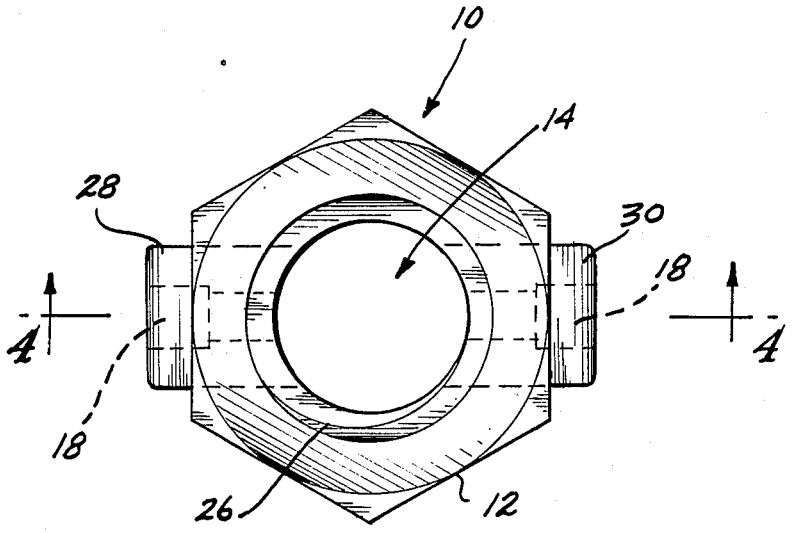
FIG. 5 is a bottom elevation view of a nut-type stuffing box cover.

As shown in FIGS. 1 through 8, the first grounding tab 28 preferentially projects a lesser distance from the nut-base 12 than does the second grounding tab 30. This difference in height of the grounding tab allows for the longitudinally disaligned mounting of the brush contacts 20 to prevent the formation of a deep groove in the shaft through wear. Each grounding tab 28 and 30 has a generally parallelepiped configuration, and includes a radiused inner surface 32 that conforms to the diameter of the central aperture 14. As best shown in FIG. 4, the radial thickness of the grounding tabs 28 and 30 is greater than the annular thickness of the nut base 12 to provide for increased strength. The nut base 12 includes two tapered radial fillet flanges 34 that join the grounding tabs 28 and 30 to the hexagonal flange 27 to strengthen the grounding tabs.

Referring still to FIG. 4, each grounding tab includes a radial through opening 18 formed generally centrally therein that projects inwardly towards the centerline of the central aperture 14. The radial openings 18 are generally diametrically opposed from each other on either side of the central aperture 14. The radial opening 18 formed in the second grounding tab 30 is disposed further away from the distal end of the nut-base 12 than is the radial opening 18 formed in the first grounding tab 28 to allow for longitudinal disalignment of the brush contacts 20. The radially outermost length of each radial opening 18 is threaded to receive a fastener 48 that retains a brush contact 20 within the cover 10.

The installation of the two brush contacts 20 in the cover 10 can be seen in FIG. 1 and the detailed view of the completed assembly shown in FIG. 6. The brush contacts 20 may be formed from any electrically conductive material that is softer than the material used to form the rotating shaft 16. One suitable material is a carbon-copper alloy. As illustrated, each contact 20 has a generally cylindrical configuration having a diameter slightly less than the internal diameter of the radius openings 18. Each brush contact further includes a short cylindrical projection 44 projecting outwardly from the radially outer end of the brush contact along the brush contact's longitudinal axis. Each cylindrical projection 44 receives one end of a conventional coil spring 46 that is inserted into the radial opening 18 behind each brush contact 20. The other end of each spring 46 is received by a cavity 50 formed within a hollow bolt 48. The hollow bolts 48 are threaded into the radial openings 18 to secure the brush contacts 20 and springs 46 in place. Additionally, a conventional jam-nut 51 may be installed on each bolt 48 to prevent loosening of the bolt after assembly. Thus retained, the springs 46 bias the brush contacts 20 against the shaft 16, and allow for radially inward movement of the brush contacts 20 as they wear to maintain contact with the shaft. A length of braided copper wire 53 may be connected from the radially outer end of each brush contact 20 to the interior of each cavity 50 in the bolts 48 to assure electrical continuity between the contacts 20 and the bolts 48. For ease of assembly, one end of the braided wire 53 is embedded in the brush contact 20 while the other end is welded or soldered to a conductive disk 57, as shown, that is sandwiched between the outer end of the spring 46 and the terminus of the cavity 50. One suitable preassembled carbon-copper brush contact 20, copper braid 53, and spring 46 is available from St. Mary's Carbon Company.

Figure 2:
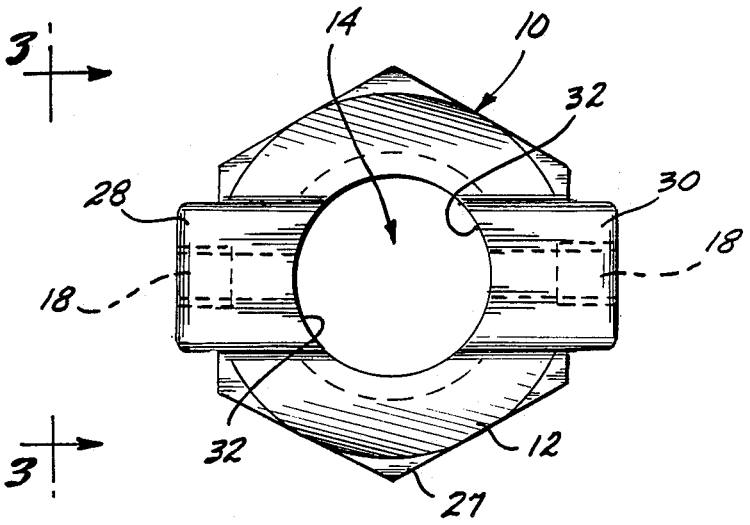
FIG. 2 is a top elevation view of a nut-type stuffing box cover.
Figure 3:
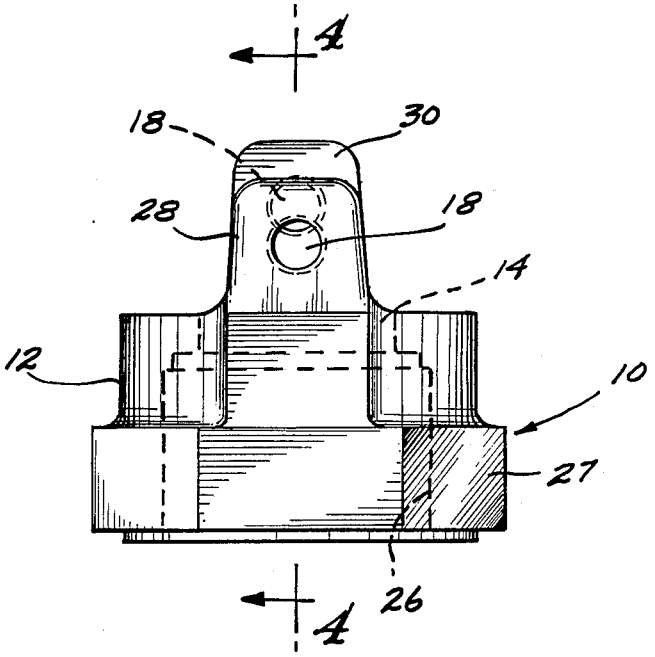
FIG. 3 is a side elevation view of a nut-type stuffing box cover showing the radial brush-mounting openings.

The spring 46 and hollow bolts 48 are formed of conductive material, such as spring steel for the spring, and brass for the bolts. A conductive path to the rotating shaft 16 is thus formed by the brush contacts 20, spring 46, hollow bolts 48, cover 10, and housing 22. As illustrated in FIG. 1, a standard electrical lead 52 may be connected to the stuffing box housing 22 by insertion and compression of a terminal lug 54 under the head of a grounding screw 55. The free end of the lead 52 may then be connected to the boat's ground system to complete the electrical grounding of the rotating shaft 16. A spade-type connector lug 54 is shown in FIG. 2, but other conventional types such as a rectangular, ring, or hook-type lug connector are equally acceptable for use. An electrical lead may alternately be connected to one of the bolts 48 instead of utilizing a separate grounding screw.

Nut-style stuffing box covers are one of the most common configurations for conventional stuffing box covers, and are installed at the point at which the propeller shaft exits the boat hull. Another conventional style of stuffing box cover that is used to seal the shaft at point of exit from the hull is a gland style. A gland-style cover that has been modified in accordance with the present invention is illustrated in FIG. 7. The gland-style stuffing box cover 56 is essentially identical to that of the modified nut-style embodiment shown in FIGS. 1 and 6, except for the means of attachment of the flange cover 56 to a stuffing box housing. A substantially diamond-shaped flange 58 formed around the distal end of the cover 56, in place of the hexagonal nut flange of the previous embodiment, mates with corresponding diamond-shaped (not shown) flanges on the stuffing box housing (not shown). Studs (not shown) projecting outwardly from the stuffing box housing flange are inserted through two or more holes 60 formed in the flange 58. Nuts (not shown) are then installed onto the studs to complete the assembly. The flange cover 56 further includes an annular sleeve projection 62 formed around the central aperture 14 and projecting downwardly from the distal end of the flange cover. The annular sleeve projection 62 is inserted into a stuffing box housing to compress the packing therein. The cover 56 includes grounding tabs and brush contacts, as in the previous preferred embodiment, to ground a shaft passing therethrough.

Another preferred embodiment is shown in FIG. 8, and is configured as a bulkhead mounted stuffing box cover 64. The bulkhead style cover 64 is used in sealing the passage of a propeller shaft through a vessel bulkhead wall. The bulkhead type cover 64 is configured exactly as the previous preferred embodiments except for the method of mounting the cover 64 to a stuffing box. A circular annular flange 66 is formed around the distal end of the cover 64. Radially spaced holes 68 are formed longitudinally through the circular flange 66 for bolt mounting the cover to a conventional bulkhead-type housing (not shown). The cover 64 is adapted with grounding tabs and brush contacts (not shown) as in the previous preferred embodiments to provide for grounding of a shaft passing therethrough.

The present invention has been described in relation to several preferred embodiments. One of ordinary skill, after reading the foregoing specification, may be able to effect various other changes, alterations, and substitutes or equivalents without departing from the broad concepts disclosed.

By way of example, although two grounding tabs are illustrated in each of the preferred embodiments shown in FIGS. 1 through 8, a single grounding tab or greater than two grounding tabs could be used. Preferably, at least two grounding tabs are included and are radially spaced evenly around the shaft to prevent axial disalignment of the propeller and to provide a backup should one brush contact fail to maintain electrical continuity with the rotating shaft. Alternately, as another example, multiple brush contacts may be mounted in each of one or more grounding tabs, rather than having multiple tabs each containing a single brush contact inserted therein.

Although generally cylindrical brush contacts have been illustrated, other commercially available brush contacts such as arcuate-shaped contacts may also be used. Rather than using coil springs to bias the brush contacts, a stack of Belleville spring washers, split spring washers, or other spring means may be used.

As a further example, brush contacts may be mounted directly into the annular sidewall of a stuffing box cover rather than providing grounding tabs for mounting.

The preferred embodiments of the present invention have been described as stuffing box covers for grounding a marine propeller shaft. Alternatively, a shaft grounding system configured in accordance with the present invention could be used to cover bearing housings or seal assembly housings that support, and/or seal different types of rotating shafts to electrically ground those shafts.

It is therefore intended that the scope of Letters Patent granted hereon be limited only by the definitions contained in the appended claims and the equivalents thereof.

The embodiments of the invention in which an exclusive property or privilege is claimed are defined as follows:

1. A stuffing box cover comprising:

a ring member having an aperture dimensioned to accommodate a rotating shaft extending therethrough and adapted for attachment to a stuffing box housing so as to form a liquid-tight seal around the rotating shaft; and a grounding assembly integral with said ring member having a conductive brush that contacts the rotating shaft so as to provide a conductive path to it and to allow substantially free movement of the rotating shaft, said grounding assembly including a brush holder attached to said ring member and spaced apart from the rotating shaft, said brush holder having an opening radially disposed relative to the rotating shaft, said conductive brush being seated within said opening and directed toward the rotating shaft, and biasing means for urging said conductive brush into conductive contact with the rotating shaft, said biasing means comprising a fastener secured within said opening and a spring means disposed within said opening extending between said fastener and said conductive brush.

2. A stuffing box cover comprising:

a ring member having an aperture dimensioned to accommodate a rotating shaft extending therethrough and adapted for attachment to a stuffing box housing so as to form a liquid-tight seal around the rotating shaft; and a grounding assembly integral with said ring member having a plurality of conductive brushes that contact the rotating shaft so as to provide a conductive path to it and to allow substantially free movement of the rotating shaft, said grounding assembly including a brush holder having a plurality of openings radially disposed around the rotating shaft, said plurality of conductive brushes being respectively seated within one of the openings and directed toward the rotating shaft, and biasing means for urging each conductive brush into conductive contact with the rotating shaft.

3. The stuffing box cover of claim 2, wherein said conductive brushes are spaced apart along a longitudinal axis of the rotating shaft.

4. The stuffing box cover of claim 3, wherein said biasing means comprises a fastener secured within said opening and a spring disposed within said opening extending between said fastener and said conductive brush.

5. A stuffing box cover comprising:

a ring member having an aperture dimensioned to accommodate a rotating propeller shaft extending therethrough and adapted for attachment to either a hull or bulkhead stuffing box housing so as to form a liquid-tight seal around the propeller shaft;

at least two grounding tabs extending from said ring member in a direction generally aligned with a longitudinal axis of the propeller shaft, each grounding tab having an integral grounding assembly that contacts the propeller shaft so as to provide a conductive path between the propeller shaft and an electrical lead and to allow substantially free movement of the propeller shaft, each of said grounding assemblies comprising an opening through said grounding tab radially disposed relative to the propeller shaft; a conductive brush seated within said opening and directed toward the propeller shaft; and biasing means for urging said conductive brush into conductive contact with the propeller shaft, each said conductive brush being offset from the other along the longitudinal axis of the propeller shaft.

6. The stuffing box cover of claim 5, wherein two grounding tabs are generally disposed on opposite sides of the propeller shaft.

7. An apparatus for electrically connecting a lead to a rotating shaft comprising:

an annular member having an aperture sized to fit around a rotating shaft, said annular member including means for attaching the annular member to a housing within which the rotating shaft turns, said annular member functioning as a cap for the housing;

integral with said annular member, means for electrically contacting the rotating shaft without substantially interfering with its rotation; and means for attaching the lead to said means for electrically contacting.

8. The apparatus of claim 7, wherein said means for electrically contacting comprises:

a brush holder attached to said annular member and spaced apart from the rotating shaft, said brush holder having an opening radially disposed around the rotating shaft;

a conductive brush seated within said opening and directed toward the rotating shaft; and biasing means for urging said conductive brush into conductive contact with the rotating shaft.

9. The apparatus of claim 8, wherein said biasing means comprises a fastener secured within said opening and a spring disposed within said opening extending between said fastener and said conductive brush.

10. The apparatus of claim 8, wherein said means for attaching comprises means adapted for attachment of the lead to said housing, said housing and said member providing a conductive path between said conductive brush and the lead.

11. The apparatus of claim 7, wherein said means for electrically contacting comprises:

a brush holder having a plurality of openings radially disposed around the rotating shaft;

a plurality of conductive brushes, each conductive brush being seated within one of the openings and directed toward the rotating shaft; and biasing means for urging each conductive brush into conductive contact with the rotating shaft.

12. The apparatus of claim 11, wherein said means for attaching comprises means adapted for attachment of the lead to said housing, said housing and said member providing a conductive path between said conductive brush and the lead.

13. The apparatus of claim 11, wherein said conductive brushes are spaced apart along a longitudinal axis of the rotating shaft.

14. The apparatus of claim 13, wherein said biasing means comprises a fastener secured within said opening and a spring disposed within said opening extending between said fastener and said conductive brush.

* * * * *